United States Patent [19]

Prüm

[11] Patent Number: 5,049,120

[45] Date of Patent: Sep. 17, 1991

[54] FOLDER WITH MEANS FOR PRODUCING A SMOOTH CUT

[75] Inventor: Sebastian Prüm, Kaiserslautern, Fed. Rep. of Germany

[73] Assignee: Albert-Frankenthal AG, Frankenthal, Fed. Rep. of Germany

[21] Appl. No.: 464,038

[22] Filed: Jan. 12, 1990

[30] Foreign Application Priority Data

Feb. 4, 1989 [DE] Fed. Rep. of Germany ..... 3903380

[51] Int. Cl.[5] ..... B31B 49/00

[52] U.S. Cl. ..... 493/342; 493/373; 493/367; 493/428

[58] Field of Search ..... 493/342, 365, 370, 357, 493/356, 358, 359, 360, 418, 424, 425, 426, 427, 428, 429, 472, 475, 471, 373

[56] References Cited

U.S. PATENT DOCUMENTS

| | | | |
|---|---|---|---|
| 1,974,149 | 9/1934 | Christman | 493/418 |
| 3,010,260 | 11/1961 | Subklew | 493/342 |
| 3,274,871 | 9/1966 | Ehlscheid | 83/99 |
| 3,363,896 | 1/1968 | McKindary | 493/418 |
| 3,667,354 | 6/1972 | Steinmetz | 493/369 |
| 3,689,061 | 9/1972 | Nystrand | 493/369 |
| 4,391,596 | 7/1983 | Fischer | 493/425 |
| 4,537,588 | 8/1985 | Ehlscheid et al. | 493/342 |

FOREIGN PATENT DOCUMENTS 3030706 8/1980 Fed. Rep. of Germany .

*Primary Examiner*—Frederick R. Schmidt
*Assistant Examiner*—John A. Marlott
*Attorney, Agent, or Firm*—Jones, Tullar & Cooper

[57] ABSTRACT

In a adapted folder for folding sheet products there is provided a combination having two knife cylinders with shear action knives of which one has pins adjacent to its knives for holding cut off trimmings of product, and a suction duct whose opening extends around part of the periphery of the cylinder with the pins. A high degree of operational reliability may be achieved without weakening the structure of the pin cylinder if compressed air nozzles are arranged in a row alternating with the pins and supplied with compressed air by timing means so that air flows from the nozzles when they register with the suction duct opening.

10 Claims, 2 Drawing Sheets

FOLDER WITH MEANS FOR PRODUCING A SMOOTH CUT

BACKGROUND OF THE INVENTION

The invention relates to a folder equipped with means for making a smooth cut and comprising two knife cylinders fitted with shear cut knives, of which one is provided with pins for piercing the paper near the shear knives in order to hold paper trimmings and is provided with a suction duct to act on part of its circumference.

A folder of this type is for instance described in the German patent 3,030,706. In such arrangements irregular operation may be caused by the stripping of the trimmings from the pins not being sufficiently reliable in the suction duct. The consequence of this is that a pile of trimmings accumulates on the pins and the lower trimmings are pushed onto the pins again and again.

Although to provide a remedy it would be possible to increase the level of vacuum in the suction duct, this would lead to an excessively intense air current surrounding suction duct and thus cause interference with folded products running through the folder. Furthermore, owing to such and air current an excessive noise level would be probable, quite apart from the added complexity of the folder.

It would also be conceivable to provide mechanical lifting means on the knife cylinder to act on the trimmings on the pins and to reliably clear them from the pins. The lifting means would however entail the provision of comparatively large cylinder wells. Particularly in the case of cylinders with a small diameter such wells would be prone to very much weaken the cylinder and cause it to be insufficiently robust.

SUMMARY OF THE PRESENT INVENTION

Taking this state of the art as a starting point, one object of the invention is to provide an arrangement of the initially described type which is so improved by using simple and inexpensive means that reliable removal of the trimmings from the pins is ensured.

A still further objective of the invention is to make this possible without any essential weakening of the cylinder.

In order to achieve these and other objects appearing from the present specification, claims and drawings, nozzles are provided adjacent to the pins and are connected with a compressed air duct, which is able to be opened and closed so that the nozzels are able to be supplied with compressed air as they move past the suction duct in synchronism with the cylinder rotation.

These features mean that the above described disadvantages may be completely eliminated. The features of the invention ensure that there is no excessive weakening of the cylinder having the pins and the nozzles. The invention is thus particularly significant in the case of knife cylinders with a small diameter and it ensures that in the case of folders for products with small paper sizes no excessive cylinder diameter is required. A still further advantage of the features in accordance with the invention is to be seen in the fact that the nozzles feed air into the suction duct so that the flow rate of air drawn in from the outside and accordingly the current of air produced outside the suction duct may be reduced and that even if there is a comparatively powerful suction effect within the suction duct there is no interference with the folded products moving through the folder and there is no production of noise. In accordance with an advantageous further development of the invention the cylinder fitted with the nozzles may be surrounded by at least one connection hole opening outwardly and connected with the nozzles and may have a stationary block arranged around it adjacent to the connection hole, such block having a supply duct connected with a compressed air duct and having an inner end swept by the opening of the connection hole. These features mean that there is the advantage of automatic control or timing of the action of the compressed air.

It is convenient if the block is able to be pivoted about the axis of the associated knife cylinder and locked at a given angle. This means that it is possible for the angular range within which the nozzles are supplied with compressed air, to be readily adjusted.

In accordance with a further advantageous feature of the invention at the end thereof the supply duct runs into a timing chamber, which subtends a certain circumferential angle which is approximately equal to the circumferential angle subtended by the suction duct. These measures lead to a particularly high degree of reliability.

It is an advantage if a bushing containing the timing chamber is arranged in the block. This feature makes the arrangement particularly simple to manufacture.

Further advantageous developments and convenient features of the invention will be gathered from the claims.

A description will now be provided of one woking example of the invention in more detail.

DETAILED DESCRIPTION OF A PREFERRED EMBODIMENT

Figure 1:
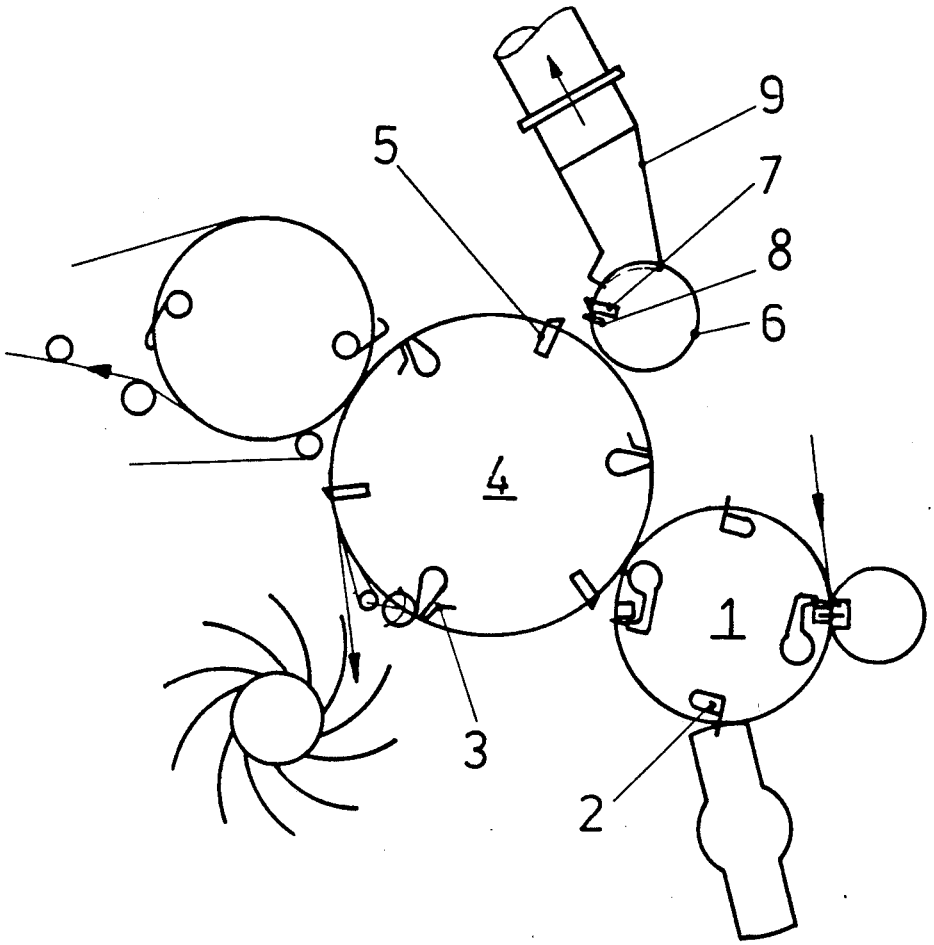
FIG. 1 is a diagrammatic view of a folder in accordance with the invention equipped with means for producing a smooth cut.

The folder seen in FIG. 1 has a folding blade cylinder 1, whose blade 2 cooperate with the folding jaws 3 of a folding jaw cylinder 4. Between the folding jaws 3, the folding jaw cylinder 4 bears shear cutting knives 5, which cooperate with shear cutting knives 7 arranged on an adjacent knife cylinder 6. The shear or scissors cutting knives 5 and 7 produce a smooth cut at the trailing edge of the products received in the folding jaws 3. The products are moved from the folding jaw clylinder 4 either to an adjacent conveyor belt or to an adjacent fan wheel.

The strip trimmings of product produced when a smooth cut is made are spiked on the stationary pins 8 and then drawn off by suction, the pins 8 being provided adjacent to the shear cutting knives 7 of the knife cylinder 6 so as to be set back from the knives 7 in the direction of rotation of the cylinder. For drawing off the strip trimmings a suction duct 9 is provided, into which a part of the periphery of the knife cylinder 6 extends so that the duct intake is covered over. In order to limit the suction effect required in the suction duct 9, the removal of the product trimmings from the pins 8 is aided by features included in the design of the cylinder.

Figure 2:
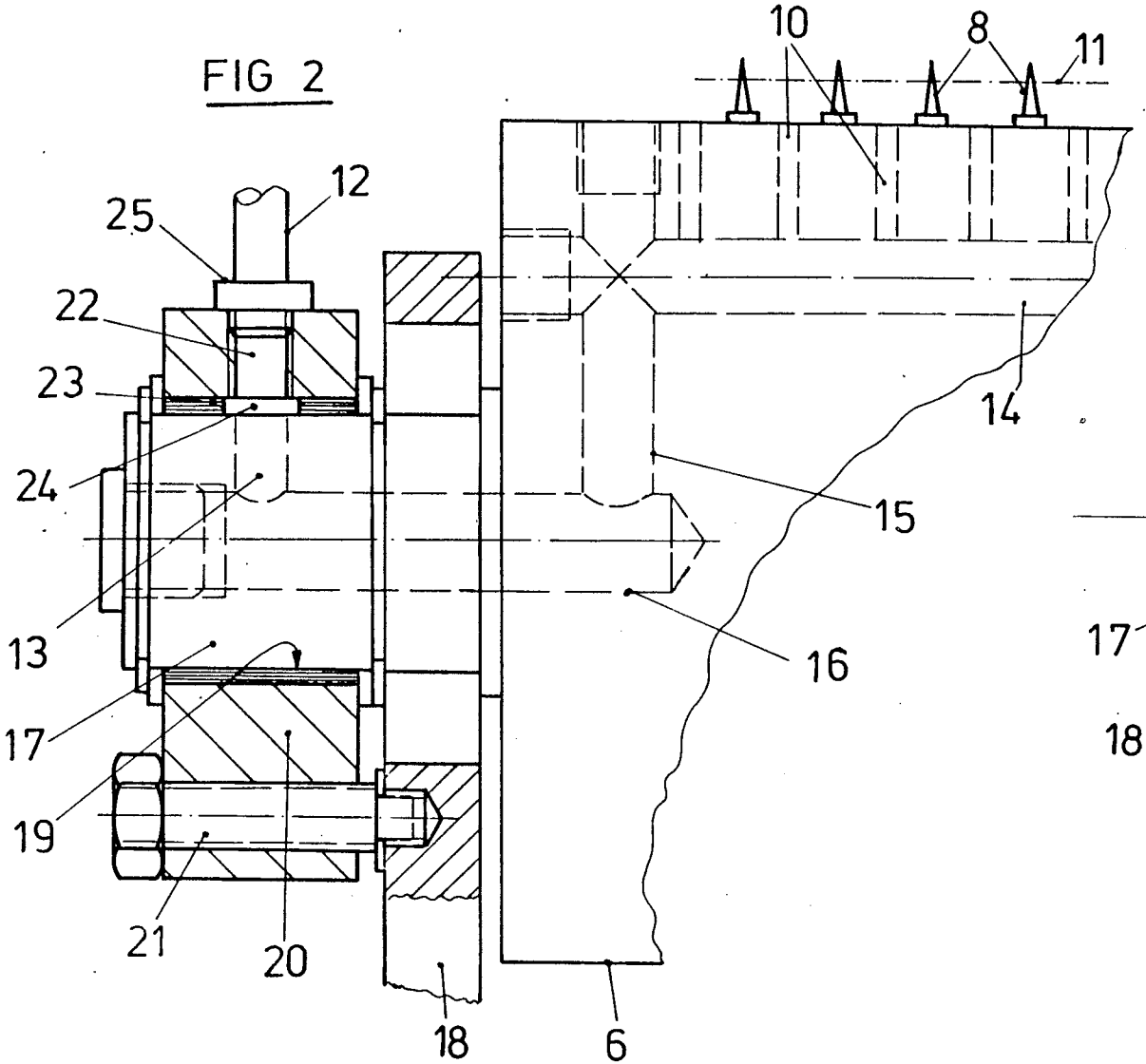
FIG. 2 is a plan view partly in section of the knife cylinder provided with nozzles.

For this purpose the knife cylinder 6 is provided with nozzles 10 adjacent to the pins 8, as may best be seen from FIG. 2. These nozzles are provided in a row and in such a manner as to alternate with the pins 8. The nozzles 10 are formed by radial holes or bores with a small diameter of approximately 2 mm.

The nozzles 10 are able to be supplied with compressed air on moving through the peripheral extent corresponding to the suction duct 9 so that the product trimmings 11 stuck on the pins 8 and indicated in FIG. 2 by a broken line are stripped and the suction duct 9 is supplied with air.

For this purpose a compressed air supply, for instance in the form of a plant compressed air line system, is connected with a compressed air line 12, which by way of a connection allowing relative rotary motion between a non-rotary pipe and a system of holes in the cylinder, such holes extending from a radially opening connection hole or bore 13 to the radial holes forming the nozzles 10. The radial holes forming the nozzles 10 extend from an axial hole or bore 14 which is shut off at the ends of the cylinder and is connected via a radial hole or bore 15, also shut off at the radial end, with an axially directed central blind hole or bore 16 shut off at its axial end and having the radial connection hole 13 opening into it. The knife cylinder 6 is provided with end journals 17, which are borne in the associated side frames 18 of the folder. One of the bearing journals 17 is provided with an extension, running past the associated frame 18, in order to accommodate part of the connection hole 13 and the air connection means allowing relative rotary motion.

Figure 3:
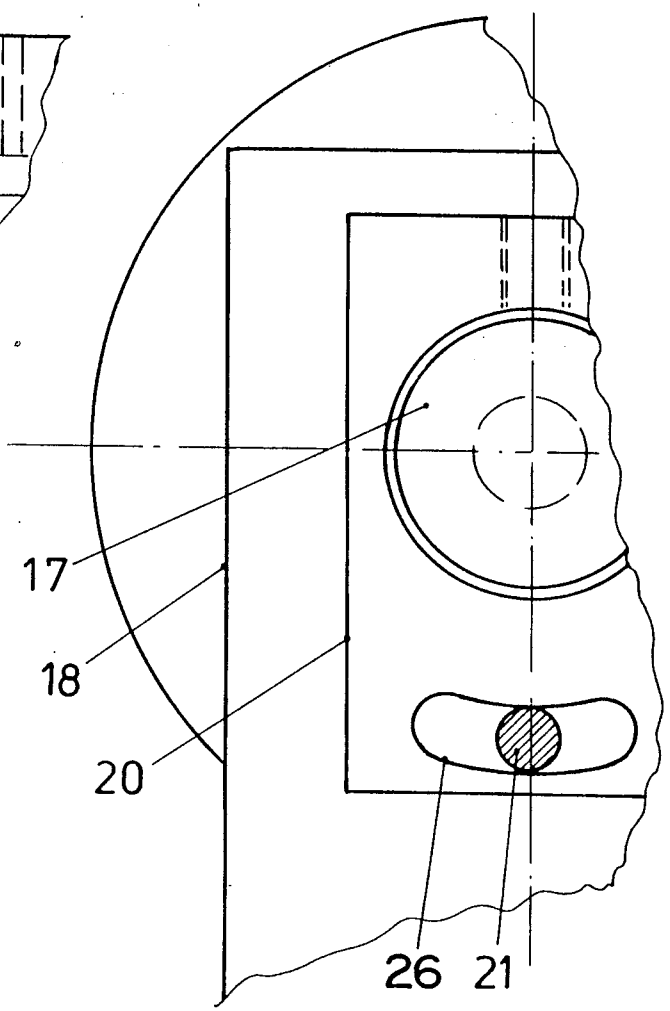
FIG. 3 is an end-on view of the knife cylinder of FIG. 2.

This means provides a pneumatic connection between a stationary pipe and the rotating parts of the system. The connection comprises a block 20 having a hole or bore 19 parallel to the cylinder axis and which is arranged on and around the extension, containing the connection hole 13, of the journal 17. The block 20, which is able to be pivoted about the axis of the cylinder, is connected by means of retaining screw 21 with the adjacent side frame 18 and is thus prevented from turning. In the axial direction, the block 20 is held in place by lock rings and spacing bushings. The block 20 is provided with a radial hole or bore forming a supply hole 22 at whose circumferential end the compressed air duct 12 is connected and which passes through as far as the hole 19 parallel to the cylinder axis. The inner opening, situated here, of the supply hole 22 accordingly is swept over by the outer end of the connection hole 13 during each rotation of the knife cylinder 6 so that the nozzles 10 are supplied with compressed air. For connection of the compressed air line 12 with the outer end of the radial hole 22 forming the supply duct there is a tube connector 25. In order to set or time the angular range in which the nozzles are to receive compressed air, the retaining screw 21 is simply slackened off and the block 20 is turned the appropriate amount. As will best be seen from FIG. 3, the block 20 is provided with a curved slot 26 concentric to the axis of the cylinder to accept the retaining screw 21.

In the illustrated example of the invention a bushing 23 contained in the hole 19 is mounted in the block 20. The bushing 23 has a circumferential recess 24 into which there runs the radial hole forming the supply duct 22. The recess 24 practically forms a control or timing chamber in order to prolong the time in which the nozzles 10 receive compressed air beyond the angular range corresponding to the diameter of the supply duct 22. The recess 24 accordingly subtends an angle about the axis which is approximately the same as the angle subtended by the extent to which the knife cylinder extends into the suction duct 9.

I claim:

1. In a folder adapted for folding products, the combination comprising:

a frame;

a folding jaw cylinder to which at least one cutting knife is mounted;

knife cylinder means mounted adjacent to said folding jaw cylinder and to said frame, said knife cylinder means having a knife cylinder defining an axis, a plurality of cutting knives and associated bearing pins mounted to said knife cylinder, a nozzle situated between each pair of adjacent bearing pins, and axially extending hole means which is connected to each nozzle, said axially extending hole means having a radial open portion on said knife cylinder means, said bearing pins being adapted to hold cut off trimming of product, and said nozzles being situated for removing the trimming from said bearing pins;

a suction duct, having an opening, arranged so that part of the circumference of said knife cylinder extends into said opening;

a compressed air supply duct;

a stationary block mounted to said knife cylinder means, said stationary block having a radial opening for receiving an end of the compressed air supply duct;

means defining a timing chamber having an extent in the peripheral direction about the axis of said knife cylinder which is greater than the diameter of said radial open portion, and subtending an angle about the axis of said knife cylinder substantially equal to the angle formed by the opening of said suction duct relative to the axis of said knife cylinder, such that compressed air is supplied to said nozzles in synchronism with rotation of said knife cylinder means and when that portion of the circumference of said knife cylinder associated with the cutting knives, bearing pins and nozzles extends into said opening of said suction duct;

means for pivoting said block about the axis of said knife cylinder for adjustment; and means for clamping said block in position after such adjustment.

2. In the folder as claimed in claim 1, wherein said means defining a timing chamber comprises a bushing situated between said block and said knife cylinder means.

3. In the folder as claimed in claim 1, wherein said kinfe cylinder means has at least one journal extending through and past said frame, said journal having said axially extending hole extending therein.

4. In the folder as claimed in claim 1 wherein the nozzles are in the form of radially directed holes.

5. In the folder as claimed in claim 1 wherein said nozzles are arranged in a row and alternate with said bearing pins.

6. In a folder adapted for folding products, the combination comprising:

a frame;

a folding jaw cylinder to which at least one cutting knife is mounted;

knife cylinder means mounted adjacent to said folding jaw cylinder and to said frame, said knife cylinder means having a knife cylinder defining an axis, a plurality of cutting knives and associated bearing pins mounted to said knife cylinder, a nozzle situated between each pair of adjacent bearing pins, and axially extending hole means which is connected to each nozzle, said axially extending hole means having a radial open portion on said knife cylinder means, said bearing pins being adapted to hold cut off trimming of product, and said nozzles being situated for removing the trimming from said bearing pins;

a suction duct, having an opening, arranged so that part of the circumference of said knife cylinder extends into said opening;

a compressed air supply duct;

a stationary block mounted to said knife cylinder means, said stationary block having a curved slot therein which is concentric with the axis of said knife cylinder and a radial opening for receiving an end of the compressed air supply duct;

means defining a timing chamber having an extent in the peripheral direction about the axis of said knife cylinder which is greater than the diameter of said radial open portion, and subtending an angle about the axis of said knife cylinder substantially equal to the angle formed by the opening of said suction duct relative to the axis of said knife cylinder, such that compressed air is supplied to said nozzles in synchronism with rotation of said knife cylinder means and when that portion of the circumference of said knife cylinder associated with the cutting knives, bearing pins and nozzles extends into said opening of said suction duct; and a retaining screw mounted on said frame so as to extend through said slot for clamping said block in a given angular position about said axis of said knife cylinder.

7. In the folder as claimed in claim 6, wherein said means defining a timing chamber comprises a bushing situated between said block and said knife cylinder means.

8. In the folder as claimed in claim 6, wherein said knife cylinder means has at least one journal extending through and past said frame, said journal having said axially extending hole extending therein.

9. In the folder as claimed in claim 6, wherein the nozzles are in the form of radially directed holes.

10. In the folder as claimed in claim 6, wherein said nozzles are arranged in a row and alternate with said bearing pins.

* * * * *